United States Patent [19]

Meier et al.

[11] Patent Number: 4,755,973

[45] Date of Patent: Jul. 5, 1988

[54] SPACE SURVEILLANCE APPARATUS WITH SOUND SOURCE AND METHOD OF SHORT-RANGE SPACE SURVEILLANCE

[75] Inventors: Walter Meier, Ovrelina; Kurt Mueller, Stäfa, both of Switzerland

[73] Assignee: Cerberus AG, Männedorf, Switzerland

[21] Appl. No.: 864,849

[22] Filed: May 20, 1986

[30] Foreign Application Priority Data

May 24, 1985 [CH] Switzerland ..... 2221/85

[51] Int. Cl.[4] ..... G08B 13/16

[52] U.S. Cl. ..... 367/93; 181/142; 340/388; 340/529

[58] Field of Search ..... 367/93; 340/529, 388; 181/142

[56] References Cited

U.S. PATENT DOCUMENTS

| | | | |
|---|---|---|---|
| Re. 25,100 | 12/1961 | Chapin . | |
| 3,098,213 | 7/1963 | Auer, Jr. | 367/93 |
| 3,343,167 | 9/1967 | Rademacher | 367/93 |
| 3,474,400 | 10/1969 | Auer et al. . | |
| 4,086,574 | 4/1978 | Miyabe | 340/529 |
| 4,608,674 | 8/1986 | Guscott | 367/93 |

FOREIGN PATENT DOCUMENTS

| | | |
|---|---|---|
| 2237613 | 5/1975 | Fed. Rep. of Germany . |
| 2443686 | 4/1976 | Fed. Rep. of Germany . |
| 3221997 | 12/1983 | Fed. Rep. of Germany . |
| 1443702 | 7/1976 | United Kingdom . |

OTHER PUBLICATIONS

Trade Journal Article "Holographie Acoustique: Bonjour Les Dégâts;" Mesures, Regulation, Automatisme, vol. 49, No. 5, Apr., 1984.

*Primary Examiner*—Glen R. Swann, III

*Attorney, Agent, or Firm*—Werner W. Kleeman

[57] ABSTRACT

A space surveillance apparatus includes at least one source of sonic radiation driven by a driver circuit as well as a processing or evaluation circuit. Upon movement of an object, or presence of a foreign object within a monitored space, the processing circuit triggers an alarm signal. Each sonic source defines the volume of its own monitored space, according to the equation:

$$L=D^2/(4\lambda),$$

wherein:

L = Length of main direction of radiation of the monitored space;

D = Diameter of diaphragm of sonic source; and

λ = Wavelength of acoustic wave.

The driver circuit drives the sonic source either in continuous mode, or in pulsed mode, and either at a constant wavelength or at a variable wavelength, i.e. in frequency modulation.

26 Claims, 4 Drawing Sheets

SPACE SURVEILLANCE APPARATUS WITH SOUND SOURCE AND METHOD OF SHORT-RANGE SPACE SURVEILLANCE

BACKGROUND OF THE INVENTION

The present invention broadly relates to a new and improved construction of an apparatus for detecting and processing sonic or acoustic radiation or energy.

In its more specific aspects the present invention relates to a new and improved construction of a sonic apparatus for motion and foreign body detection in short-range surveillance applications, comprising a source of acoustic or sonic radiation or energy driven by a driver circuit, and including a processing or evaluation circuit which, upon movement of an object, or in the presence of a stationary foreign object which is more solid than ambient air within a monitored space, triggers an alarm signal.

In other words, the short-range surveillance device of the present invention is of the type comprising at least one source of sonic energy having a membrane and a main direction of radiation, a driver circuit for driving the at least one source of sonic energy and an evaluation circuit for emitting an alarm signal in response to motion and/or sojourn within a surveillance space of an object more solid than ambient air.

The method aspects of the present invention for monitoring a surveillance space comprise the steps of employing a driver circuit for driving at least one source of sonic energy having an impedance.

A similar intrusion detector is described in German Patent No. 2,237,613. A sonic source is driven continuously at a constant frequency corresponding to the resonant frequency of a space. This known embodiment of a detector is, however, afflicted with the disadvantage of being operable only within enclosed spaces. Furthermore, the volume of the space must be closely estimated and openings, such as doors, windows, ventilators or cracks must be taken into consideration. This procedure is necessary in order to be able to tune to the space's resonant frequency. This known detector can only operate as a surveillance apparatus if its sonic source emits radiation at the resonant frequency of the space in question. Its installation is arduous, time-consuming and requires specially trained personnel. If the resonant frequency changes or is altered during service, i.e., by changes in the spaces's volume or changes of the space's apertures, this known detector will generate false alarms. Another disadvantage of this known. detector consists in its tendency to trigger false alarms due to the presence of laminar or turbulent air currents or due to insects flying within the monitored space.

SUMMARY OF THE INVENTION

Therefore, with the foregoing in mind, it is a primary object of the present invention to provide a new and improved construction of an apparatus and method for the detection of foreign objects within a monitored space which is not afflicted with the aforementioned drawbacks and limitations of prior art constructions.

It is another object of this invention to provide a new and improved construction of an apparatus and method for the detection of a foreign object within a monitored space which is not limited to an enclosed space and is operable within an open area outside of any building.

It is a still further significant object of this invention to provide a new and improved construction of an apparatus and method for the detection of a foreign object within a monitored space which can be individually adjusted to a specific surveillance or monitoring requirement.

It is a still further important object of this invention to provide a new and improved construction of an apparatus for the detection of a foreign object within a monitored space which can be continuously adjusted during operation, not just at installation of the apparatus.

Now in order to implement these and still further objects of the invention, which will become more readily apparent as the description proceeds, the short-range surveillance device of the present invention is manifested by the features that the surveillance space has a length dimension extending in the main direction of radiation and the length dimension is at least approximately determined by the relationship:

$$L=D^2/(4\lambda);$$

the driver circuit serves for driving the source of sonic energy selectively either continuously at a constant wavelength, continuously in frequency-modulation, pulsedly at a constant frequency or pulsedly in frequency-modulation, wherein: L is the length dimension, D is the diameter of the membrane and $\lambda$ is a selected wavelength.

The method of the present invention is manifested by the features that it comprises the steps of driving the at least one source of sonic energy selectively either continuously at a constant wavelength, continuously in frequency-modulation, pulsedly at a constant wavelength or pulsedly in frequency-modulation such that the impedance is altered by an object in the surveillance space; monitoring the impedance of the source of sonic energy; comparing the monitored impedance with a reference or set value; and generating an alarm signal when the monitored impedance departs from the reference or set value by more than a threshold value.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
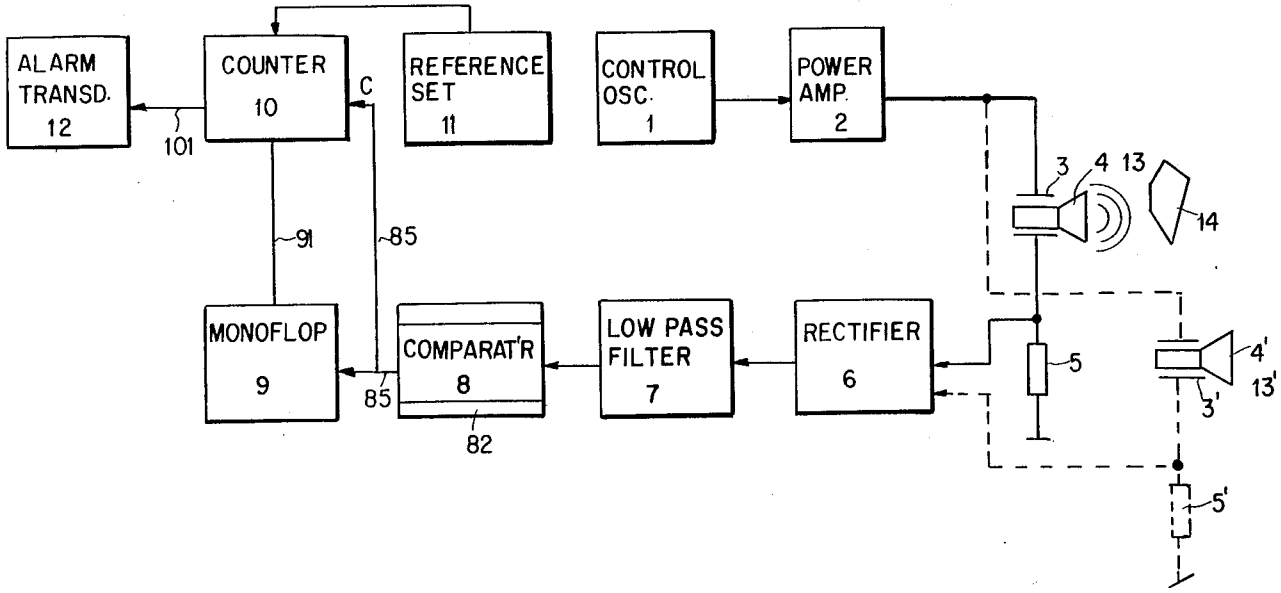
FIG. 1 is an embodiment of the space surveillance apparatus, including the electronic processing circuit.

Describing now the drawings, it is to be understood that to simplify the showing thereof, only enough of the structure of the short-range surveillance device has been illustrated therein as is needed to enable one skilled in the art to readily understand the underlying principles and concepts of the present invention. Turning now specifically to FIG. 1 of the drawings, the device illustrated therein by way of example and not limitation, will be seen to comprise a source 3 of sonic or acoustic energy or radiation, which can be configured as a normal loudspeaker, a capacitive loudspeaker or as a piezoceramic loudspeaker. An example of a suitable sonic source 3 is the type T 25-24 B manufactured by the Nippon Ceramic Company. The sonic source 3 is connected to driver and processing or evaluation circuits 1, 2, 4, 5, 6, 7, 8, 9, 10, 11 and 12. A second sonic source 3', or several sonic sources 3, 3' etc. can be connected to the same circuitry, (dashed lines of FIG. 1) and will be described more closely later. The sonic source 3 is driven by a driver-circuit 1, 2 comprising a control oscillator 1 (e.g., National Semiconductor Type LM 556 C), which is connected to an electronic power amplifier 2 (e.g., National Semiconductor Type LM 383), such that the sonic source 3 emits sonic or acoustic waves into a surveillance space or zone 13 to be monitored. The frequency of the sonic waves may be located in the audible, sub-sonic or the ultrasonic range of the acoustic spectrum. The entire frequency spectrum may, for example, be located between 1 Hz and 100 kHz. The sonic waves may be radiated or emitted in a continuous or in a pulsed configuration, with the wavelength λ remaining constant.

Figure 6:
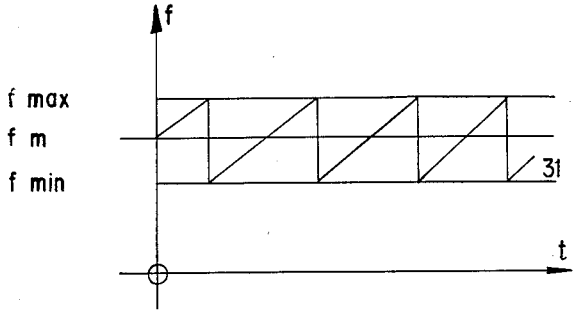
FIGS. 6 and 7 depict various forms of the emitted sonic waves, with continuous, periodic frequency modulation, as seen at the exit of the sonic radiation source.
Figure 7:
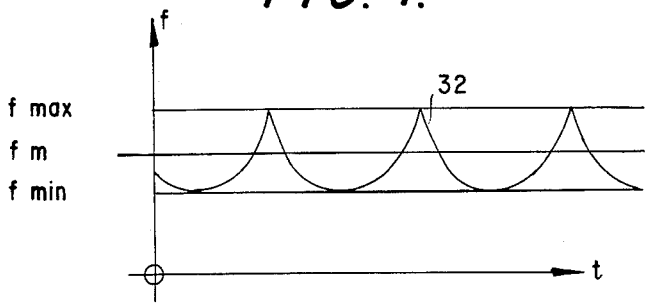
Figure 8:
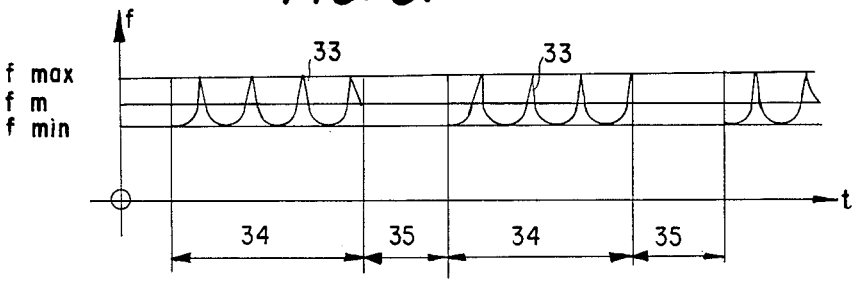
FIG. 8 depicts forms of the radiated sonic waves in pulsed frequency modulation, as seen at the exit of the sonic radiation source.

Continuous radiation or emission generates a so-called steady state sound or constant tone (e.g. standing waves). Pulse modulated radiation is to be understood as sequential radiation of individual pulse groups or packets separated by time intervals. The sonic waves may also be radiated in a continuous but frequency-modulated configuration, as depicted in FIGS. 6 and 7. There further exists the possibility of radiating sonic waves in frequency-modulated pulse sequences, as depicted in FIG. 8. In this case, intervals separate individual groups of frequency-modulated sonic waves. Radiation at a constant wavelength (continuous or pulsed) is preferred for cases where a moving object 14 is expected within the surveillance space 13. Frequency-modulated radiation (continuous or pulsed) should be selected for cases where the object 14 within the surveillance space 13 remains stationary. These relationships will be discussed in more detail in connection with FIGS. 6, 7 and 8.

The control oscillator 1 depicted in FIG. 1 (e.g., National Semiconductor Type LM 556 C), is arranged such that the various configurations of sonic waves, as well as the desired frequency, can be selected either by an operator or from a central control room to which several apparatuses are connected. The various configurations of sonic waves may be selected or altered either before or during operation. Such selection or modification procedures may originate from a control program, which can be arranged within the surveillance apparatus (e.g., control oscillator 1) or within a remote central supervising facility. The commercial power amplifier 2 (e.g., National Semiconductor Type LM 383) amplifies the output pulses of the control oscillator 1 such that a number of sonic sources 3, 3' or can be operated simultaneously, as indicated in FIG. 1.

The monitored space or surveillance space 13 irradiated by the sonic source 3 is not defined by walls, i.e., need not be a room of a building. The surveillance space 13 may be arranged within a much larger space of a building or at the exterior. The monitoring or surveillance apparatus defines its own monitored or surveillance space 13.

This is determined as a function of the diameter of a diaphragm 4 of the sonic source 3, and the wavelength λ of the sonic waves used, which conjointly determine a length L of the surveillance space 13. Furthermore, the most advantageous spatial configuration of the surveillance space 13 is determined for a specific monitoring procedure. All of these relations will be described in more detail in connection with FIGS. 2, 3 and 4. For this reason, FIG. 1 does not include boundary lines defining or governing the shape of the surveillance space 13.

The operating principle of the processing or evaluation circuit 6 . . . 10 in FIG. 1 will be explained with the aid of the two following examples. The first example is based on a moving object 14 within the surveillance space 13. The second example is based on a stationary object 14 within the surveillance space 13.

Figure 5:
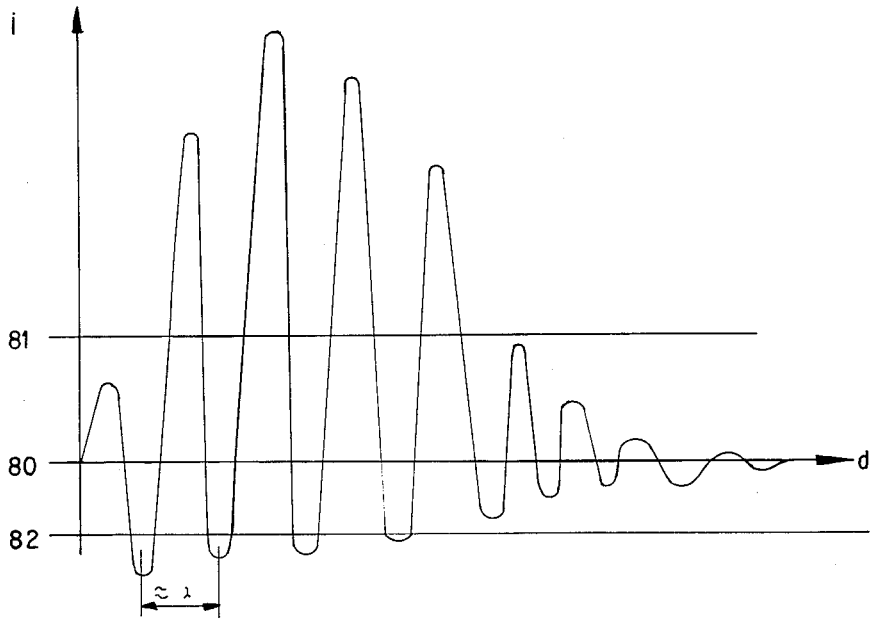
FIG. 5 shows a graphical depiction of the current flow variation within the sonic radiation source, as a function of the presence of a foreign object within the monitored space.

For monitoring moving objects, the control oscillator 1 is adjusted, either by an operator or from the control room, e.g., by a program, such that the sonic source 3 emits sonic or acoustic waves with a constant wavelength λ, either continuously, or pulsedly, into the surveillance space 13, whose length L together with its shape are configured such as to provide optimum conditions for the surveillance process. The object 14 is assumed to be a burglar, a tool, a vehicle, a piece of jewelry, a picture, keys, a piece of furniture or other objects of small dimensions made of plastic, wood, paper or textile, more solid than ambient air, and moving within the surveillance space. Under the term "moving" shall be understood an object 14 intruding into the surveillance space 13, and moving within it, or moving out of this surveillance space 13. Due to the movement of the object 14, a steady-state current 80 within the sonic source 3 changes as depicted in FIG. 5 in relation to a first quiescent value.

These current changes generate a proportional voltage change across a resistance 5, which is rectified by the rectifier 6 (constituted by operational amplifier means e.g., National Semiconductor Type LM 324 and additonal diodes and resistors) and processed by a low-pass filter 7 (constituted by operational amplifier means e.g., National Semiconductor Type LM 324 and additional capacitors and resistors). The lower frequency limit of the low-pass filter 7 is preferably at most 1/10th of the sonic or acoustic frequency of the sonic source 3, so that a comparator 8 senses only a small residual AC-component, lower than the switching hysteresis voltage of the comparator 8. Undefined switching states are thus avoided, thus avoiding possible false alarms caused by the processing or evaluation circuit 6 . . . 12. The commercially available comparator 8, (e.g., National Semiconductor Type LM 318) comprises two threshold values or levels stored therein, designated by the two references numerals 81 and 82 of FIGS. 1 and 5 and generates a logic output signal having a second quiescent value. The upper threshold level 81 lies, e.g., 30% above the steady-state current 80 flowing within the sonic source 3 whenever no object is located within the surveillance space 13, or whenever the object 14 is not moving. The lower threshold level 82 may lie, for instance, 30% below the same steady-state current 80. The FIG. 30% is considered particularly advantageous for both threshold levels; nevertheless, other values may be used. This is a function of the particular surveillance requirements. Whenever the object 14 starts moving, either the first or the second threshold level 81 or 82 at the comparator 8 will be exceeded (FIG. 5). Thus, the comparator 8 produces an output signal on the lines or conductors such as an electrical logic conductor 85, which triggers a monoflop or monostable multivibrator 9 (e.g., National Semiconductor Type 74 C 221). The same pulse has no effect upon a counter 10, since the counter 10 has not yet been triggered by the monostable multivibrator 9 to attain operational status. The monostable multivibrator 9 and the counter 10 (e.g., National Semiconductor Type CD 40163) are commercially available components. The monostable multivibrator 9 resets the counter 10 via a conductor 91 for new counting operations.

Hence, any exceeding of the upper or lower threshold levels 81 or 82 by the current i within the sonic source 3 generates counting pulses on conductors 85 which arrive at a counting input C of the counter 10, thus incrementing the counter reading by one unit. These counting pulses on the conductors 85 have no influence upon the monostable multivibrator 9. The monostable multivibrator 9 enables the counter 10 for receiving counting pulses from the conductors 85 through the counting input C, for a predeterminate length of time. This time period, also known as a time window, can be defined by external circuit components connected to the monostable multivibrator 9. Time values may be chosen for instance between 0.001 seconds and 20 seconds. At the end of the time window, the monostable multivibrator 9 transmits a termination or "END" signal on a conductor 91, which inhibits the counter 10 for any further counting pulses. Whenever, during the time window, the counter contents reach a preset reference or set value set by a reference value setting device 11, it generates on a conductor 101 an output signal for an alarm transducer 13, which may be of the acoustic, electrical or optical type. At the end of the time window, the contents of the counter 10 are reset to zero by the "END" signal, so that the counter 10 can restart at zero for the subsequent time window which will start upon again exceeding one of the threshold levels 81 or 82. Whenever the counter 10 does not reach the aforementioned predetermined or set value of the setting device 11 during a time window, the counter contents are reset by the "END" signal, so that the counter 10 can restart with the value zero during the subsequent time window, which starts upon exceeding the threshold level 81 or 82.

In the second example, it is assumed that the object 14 within the surveillance space 13 is stationary. This is the case whenever the object 14 has, for example, been placed within the space being monitored by the surveillance apparatus according to this invention for preparing criminal acts, such as thefts or sabotage. It is also conceivable that during operation of the surveillance apparatus, the object 14 may move along trajectories corresponding to oscillation nodes or oscillation peaks of the sonic waves being emitted. The object 14 would then not be detected by the sonic waves as described in the first example; with this type of sonic waves, the object 14 is recognized only as a stationary body. For detecting stationary objects 14, the control oscillator 1 is adjusted such that the sonic source 3 emits sonic waves either continuously (FIGS. 6 and 7), or pulsedly (FIG. 8), and with frequency-modulation. The modulation frequency amounts to a fraction of the sonic frequency, e.g., 0.0001 to 0.1. As already mentioned, the oscillator 1 is adjustable, either by an operator or by means of a predetermined program within the oscillator 1 or in the central control system.

The frequency-modulated sonic waves impinge over the stationary object 14 within the surveillance space 13. Thus, the impedance within the sonic source or emitter 3 is altered, so that a current wave-form according to FIG. 5 will be generated. A voltage arises across the resistance 5, which is proportional to the current changes. Subsequently, signal processing or evaluation takes place in the rectifier 6, the low-pass filter 7 and the comparator 8, in the same fashion as described in the previous example. The monostable multivibrator 9 generates the time window, within which time period the counter 10 counts the number of times the threshold levels 81 and 82 are exceeded, and produces a signal for the alarm transducer 12 if the counter contents exceed the preset reference value. The counter 10 is reset to zero after each time window.

Operation is analogous to the previous Example. The frequency-modulated sonic waves are turned on only for a short time, e.g., 1 . . . 5 minutes. During that time, all objects within the surveillance space will be detected; the next operation reverts to sonic waves which are not frequency-modulated, as in Example 1. Once again, this may be performed by an operator or by a preset program at the oscillator 1, or within the not depicted central control location. Such switching operations can take place several times during the operation of the surveillance apparatus according to this invention. The wavelength $\lambda$ can also be changed during operation so that the length L of the monitored space can be made shorter or longer, according to momentary or current requirements.

The geometrical form of the close proximity of the sonic source 3, and thus the shape of the surveillance space 13, can be influenced within certain limits by the shape of the diaphragm 4, and by the form, or the omission of, a radiation horn 16. The geometry of the diaphragm 4 primarily influences the basic configuration of the surveillance space or zone 13, while the radiation horn 16 primarily influences a conical portion of the surveillance space 13. Rotationally symmetrical spatial configurations are obtained with circular diaphragms 4, and circularly symmetrical radiation horns 16. Non-rotationally symmetrical spatial configurations are obtained with oval and elliptical diaphragms 4, and correspondingly shaped radiation horns 16.

Figure 2:
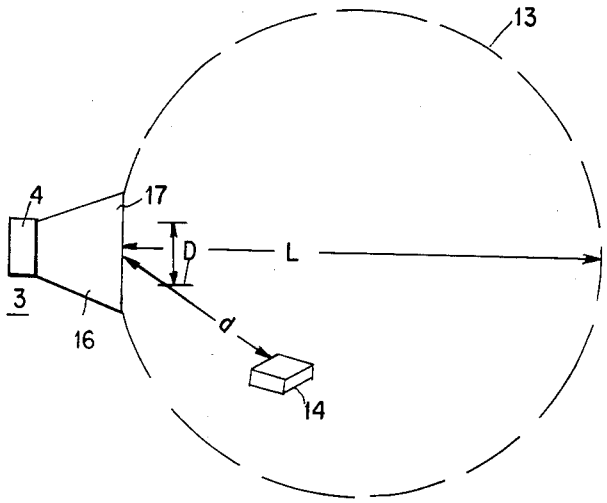
FIGS. 2, 3 and 4 depict various configurations of monitored spaces.

FIG. 2 depicts a rotationally symmetrical, highly curved surveillance space or spatial configuration 13, which is based upon a circular diaphragm 4 and a very wide-aperture radiation horn 16.

This embodiment comprises a diaphragm 4 having a diameter D=40 cm. A frequency of 66 kHz, corresponding to a wavelength $\lambda=5$ mm results in a length or length dimension L of the surveillance space 13 as measured in the main direction of sound radiation emitted by the sound energy source 3 or its diaphragm 4, according to the relation:

$$L=D^2/(4\lambda)=800 \text{ cm}$$

Figure 3:
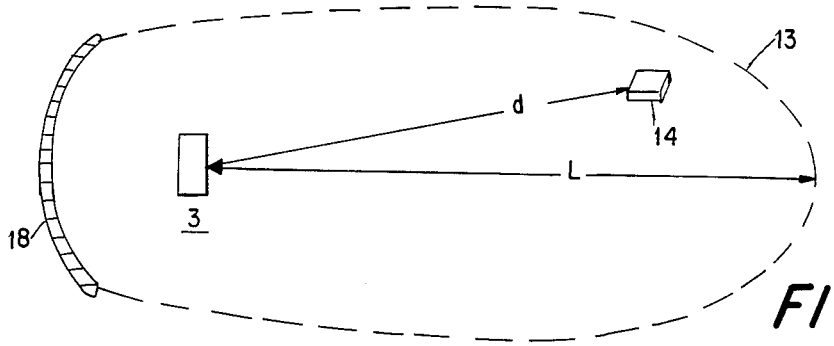

FIG. 3 depicts a longitudinally elongate, rotationally symmetrical surveillance space 13 derived from a sonic source 3 arranged at the focal point of a parabolic reflector 18. This arrangement provides an increased operating range.

Figure 4:
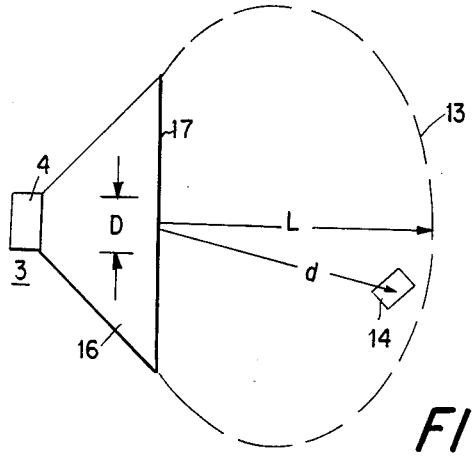

FIG. 4 depicts a rotationally non-symmetric surveillance space or spatial configuration 13, based on an elliptical diaphragm 4 and an elliptical radiation horn 16. In this example, the diaphragm diameter D=20 cm. The radiation source 3 is driven at a frequency f=16.5 kHz, corresponding to a wavelength λ=2 cm. According to the relation:

$$L=D^2/(4\lambda),$$

the length—of this—space—being monitored amounts to 50 cm, as measured in the main direction of sound radiation emitted by the sound energy source 3 or diaphragm 4.

For the embodiments depicted in FIGS. 2, 3 and 4, the length L of the surveillance space 13 may be extended or shortened by changing the wavelength λ accordingly or by adjusting the oscillator 1. FIGS. 2, 3 and 4 depict a small selection of various surveillance spaces or spatial configurations 13. Basically, there exist unlimited values of lengths L, as well as shapes of the surveillance space 13, with the method described.

The graphical depiction in FIG. 5 shows the effective or root mean square value of the current in the sonic source 3, which has a constant value 80 in the absence of an object 14; it also shows the current variations upon introducing an object 14, according to the initially described Example. A distance d between the diaphragm 4 and the object 14 is recorded on the abcissa. The effective or root mean square value of i, the current flowing in the sonic source 3, is recorded on the ordinate. It is apparent that upon motion of an object 14, current variations exceed by a considerable amount the threshold values 81 and 82, which are set within the comparator 8. The further the object 14 is located from the diaphragm 4, the smaller are the current changes. They may not exceed the threshold values 81 at long distances. This means that the system is limited to short-range surveillance only.

FIG. 6 shows a graphical depiction of frequency-modulated sonic frequencies 31, which are emitted continuously from the sonic source 3. Frequency-modulation takes place between a maximum frequency $f_{max}$ and a minimum frequency $f_{min}$, which are at equal distances from the center frequency, e.g., 30%. The time t lies on the abcissa and the frequency f on the ordinate.

FIG. 7 depicts sonic waves 32, which are emitted continuously from the sonic source 3 with a differently modulated frequency. Otherwise, the conditions correspond to those of FIG. 6.

In addition to the depictions of frequencies 31 and 32 in FIGS. 6 and 7, further frequency-modulated forms of sonic or acoustic waves can be generated by the oscillator 1. While FIGS. 6 and 7 are representations of continuously frequency-modulated sonic or acoustic waves, the frequency of a pulsedly frequency-modulated sound 33 is illustrated in FIG. 8.

The frequency modulation of FIG. 8 takes place between two limiting values $f_{max}$ and $f_{min}$ disposed at a spacing of 30% each from the center or middle frequency $f_m$, just as in FIGS. 6 and 7. The sonic or acoustic wave 33 is radiated or emitted by the source of sonic or acoustic energy or radiation 3 as pulses 34 or as wave packets. The pulses 34 are separated from one another by pauses or gaps 35. The pulses 34 can be greater than, equal to or smaller than the pauses or gaps 35. The duty factor relating the size of the pulses 34 to the size of the pauses or gaps 35 is individually determined in relation to each surveillance problem.

Analogous considerations apply to the second sonic or acoustic energy or radiation source 3' and its associated diaphragm 4', resistor 5' and surveillance space 13' to be monitored for moving or stationary objects.

In summary, two sources 3, 3' of sonic or acoustic energy or radiation and one driver and evaluation circuit 1 through 12 are illustrated in FIG. 1. In principle, a plurality of sources 3, 3' of sonic or acoustic energy or radiation can be connected to the same driver and evaluation circuit 1 through 12. When employing a relatively large number of sources 3, 3' etc. of sonic or acoustic energy or radiation, each source 3, 3' of sonic or acoustic energy or radiation can be individually connected to its own driver and evaluation circuit 1 through 12 or, alternatively, each source 3, 3' of sonic or acoustic energy or radiation can be individually connected to its own driver circuit 1, 2 or a plurality of sources 3, 3' etc. of sonic or acoustic energy or radiation can be conjointly connected to an evaluation circuit 6 through 12 and vice versa. When a plurality of sources 3, 3' etc. of sonic or acoustic energy or radiation are provided in an array, each source of sonic or acoustic energy or radiation can define a different surveillance space 13 or sonic or acoustic waves of different frequency and different operation mode or both (initially described Example and subsequently described Example). During operation of the surveillance device or devices, the criteria can be changed from one source of sonic or acoustic energy or radiation to the other. This depends upon the surveillance tasks of the momentary or current application.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A short-range surveillance device, comprising:

at least one source of sonic energy having a membrane of a preselected diameter and a main direction of radiation;

said at least one source of sonic energy emitting sonic radiation of a preselected wavelength;

a driver circuit for driving said at least one source of sonic energy;

an evaluation circuit for emitting an alarm signal in response to at least any one of motion and sojourn, or both, within a surveillance space of an object more solid than ambient air;

said surveillance space having a length dimension extending in said main direction of radiation;

said length dimension being at least approximately determined by the relationship:

$$L=D^2/(4\lambda)$$

wherein L=said length dimension, D=said preselected membrane diameter, and λ=said preselected wavelength of said sonic radiation; and said driver circuit serving for driving said source of sonic energy selectively either continuously at a constant preselected wavelength, continuously in frequency-modulation, pulsedly at a constant preselected wavelength or puslsedly in frequency-modulation.

2. The short-range surveillance device as defined in claim 1, wherein:

said evaluation circuit comprises a counter and a time window generating circuit connected to said counter for generating a predetermined time window;

said at least one source of sonic energy passing a root means square current;

said root means square current being subject to an initial variation in response to said motion of said object in said surveillance space;

said time window generating circuit of said evaluation circuit being capable of being triggered by said initial variation for initiating said predetermined time window;

said root mean square current being subject to further variations in response to further motions of said object in said surveillance space;

said counter being operatively connected to said at least one source of sonic energy and counting said further variations;

a reference value setting device connected to said counter for predetermining a reference counter state; and an alarm device operatively connected to said counter for triggering an alarm upon attaining said reference counter state within said predetermined time window.

3. The short-range surveillance device as defined in claim 2, wherein:

said time window generating circuit comprises an electrical conductor for transmitting a termination signal; and said termination signal serves for resetting said counter to zero upon said termination of said predetermined time window.

4. The short-range surveillance device as defined in claim 2, wherein:

said time window generating circuit comprises a monostable multivibrator; and said monostable multivibrator enables said counter to start counting said further variations in said root mean square current from the start of said predetermined time window.

5. The short-range surveillance device as defined in claim 2, further including:

an electrical signal conductor interconnecting said counter and said alarm device; and said counter generates an alarm output signal on said electrical signal conductor and thereby actuates said alarm device upon attainment of said reference counter state within said predetermined time window.

6. The short-range surveillance device as defined in claim 1, further including:

a current-measurement resistor connected in circuit with said at least one source of sonic energy;

said at least one source of sonic energy passing an electrical current through said current-measurement resistor during operation of said at least one source of sonic energy;

said electrical current inducing across said current-measurement resistor a measurement voltage proportional to said electrical current;

a rectifier for rectifying said measurement voltage and connected in said evaluation circuit;

a low-pass filter of said evaluation circuit being series connected to said rectifier for filtering said measurement voltage to provide a rectified and filtered measurement voltage;

said low-pass filter having a cut-off frequency;

said at least one source of sonic energy emitting sonic energy at a predetermined acoustic frequency; and said cut-off frequency being at most ten percent of said predetermined acoustic frequency.

7. The short-range surveillance device as defined in claim 6, further including:

a comparator circuit connected in said evaluation circuit;

an electrical logic conductor operatively interconnecting said comparator circuit and said time window generating circuit;

said comparator being connected on its input side to said low-pass filter and, on its output side, to said electrical logic conductor;

said electrical current passing through said current-measurement resistor during operation of said at least one source of sonic energy, having a first quiescent current value;

said measurement voltage induced across said current-measurement resistor defining a rectified and filtered measurement voltage and a first quiescent voltage value;

said comparator circuit setting a predetermined upper threshold value and a predetermined lower threshold value relative to said first quiescent voltage value;

said electrical logic conductor transmitting a logic output signal to said counter and to said time window generating circuit whenever the rectified and filtered measurement voltage received on the input side of said comparator circuit exceeds and upper threshold value of said comparator circuit;

said electrical logic conductor assuming a quiescent state; and said electrical logic conductor assuming said quiescent state whenever said rectified and filtered volatage has a value below said upper or lower threshold value set at said comparator circuit.

8. The short-range surveillance device as defined in claim 1, wherein:

said driver circuit comprises a control oscillator and an electronic power amplifier;

said at least one source of sonic energy having a resonant frequency; and said control oscillator operating at said resonant frequency of said at least one source of sonic energy and continuously controlling said electronic power amplifier at said resonant frequency.

9. The short-range surveillance device as defined in claim 1, wherein:

said driver circuit comprises a control oscillator and an electronic power amplifier;

said at least one source of sonic energy has a resonant frequency; and said control oscillator operates at said resonant frequency of said at least one source of sonic energy and pulsedly controls said electronic power amplifier at said resonant frequency.

10. The short-range surveillance device as defined in claim 1, wherein:

said driver circuit comprises a control oscillator and an electronic power amplifier;

said electronic power amplifier being continuously controlled such that said sonic energy emitted by said at least one sonic energy source contstitutes frequency-modulated sonic radiation defining a minimum frequency, a middle frequency and a maximum frequency;

said minimum frequency being at least 30% below said middle frequency; and said maximum frequency being at least 30% above said middle frequency.

11. The short-range surveillance device as defined in claim 1, wherein:

said driver circuit comprises a control oscillator and an electronic power amplifier;

said electronic power amplifier being pulsedly controlled such that said sonic energy emitted by said at least one sonic energy source constitutes frequency-modulated sonic radiation defining a minimum frequency, a middle frequency and a maximum frequency;

said minimum frequency being at least 30% below said middle frequency; and said maximum frequency being at least 30% above said middle frequency.

12. The short-range surveillance device as defined in claim 1, wherein:

said at least one source of sonic enegy comprises a predetermined number of sources of sonic energy selectively arranged either in mutual juxtaposition or in mutual superposition or in mutual juxtaposition and superposition;

each said sonic energy source defines a respective surveillance space;

each sonic energy source of said predetermined number of sources of sonic energy defines said length dimension of the surveillance space in said main direction of radiation; and said length dimensions are mutually substantially identical.

13. The short-range surveillance device as defined in claim 12, wherein:

each said surveillance space has a predetermined form; and said predetermined form of each said surveillance space being selectively either the same or different for each said sonic energy source.

14. The short-range surveillance device as defined in claim 12, wherein:

said evaluation circuit comprises a plurality of evaluation circuits; and each one of said predetermined number of sources of sonic energy is connected to an associated evaluation circuit of said plurality of evaluation circuits.

15. The short-range surveillance device as defined in claim 1, wherein:

said at least one source of sonic energy comprises a predetermined number of sources of sonic energy selectively arranged either in mutual juxtaposition or in mutual superposition or in mutual juxtaposition and superposition;

each said sonic energy source defines a respective surveillance space;

each sonic energy source of said predetermined number of sources of sonic energy defines said length dimension of said respective surveillance space in said main direction of radiation; and said length dimensions are mutually different.

16. The short-range surveillance device as defined in claim 15, wherein:

each said surveillance space has a predeterminate form; and said predeterminate form of each said surveillance space being selectively either the same or different for each said sonic energy source.

17. The short-range surveillance device as defined in claim 15, wherein:

said evaluation circuit comprises a plurality of evaluation circuits; and each one of said predetermined number of sources of sonic energy is connected to an associated evaluation circuit of said plurality of evaluation circuits.

18. The short-range surveillance device as defined in claim 1, wherein:

said evaluation circuit comprises at least two evaluation circuits;

said at least one source of sonic energy comprises at least two sources of sonic energy; and each one of said at least two sources of sonic enegy is connected to an associated evaluation circuit of said at least two evaluation circuits.

19. The short-range surveillance device as defined in claim 1, wherein:

said at least one source of sonic energy is connected to said driver circuit.

20. The short-range surveillance device as defined in claim 19, wherein:

said predetermined time window has a termination;

said time window generating circuit comprises an electrical conductor for transmitting a termination signal; and said termination signal serves for resetting said counter to zero upon termination of said predetermined time window.

21. The short-range surveillance device as defined in claim 19, wherein:

said time window generating circuit comprises a monostable multivibrator; and said monostable multivibrator enables said counter to start counting said further variations in said root mean square current from the start of said predetermined time window.

22. The short-range surveillance device as defined in claim 19, further including:

an electrical signal conductor interconnecting said counter and said alarm device; and said counter generating an alarm output signal on said electrical signal conductor and thereby actuating said alarm device upon attainment of said reference counter state within said predetermined time window.

23. The short-range surveillance device as defined in claim 1, wherein:

said evaluation circuit comprises a counter and a time window generating circuit connected to said counter for generating a predetermined time window;

said at least one source of sonic energy passing a root mean square current;

said root mean square current being subject to an initial variation in response to said sojourn of said object within said surveillance space;

said time window generating circuit of said evaluation circuit being capable of being triggered by said initial variation for initiating said predetermined time window;

said root mean square current being subject to further variations in response to continuous or pulsed frequency-modulated radiation;

said counter being operatively connected to said at least one source of sonic energy and counting said further variations;

a reference value setting device connected to said counter for predetermining a reference counter state; and an alarm device operatively connected to said counter for triggering an alarm upon attaining said reference counter state within said predetermined time window.

24. A method for monitoring a surveillance space, comprising the steps of:

employing a driver circuit for driving at least one source of sonic energy having an impedance;

driving said at least one source of sonic energy selectively either continuously at a constant preselected wavelength, continuously in frequency-modulation, pulsedly at a constant preselected wavelength or pulsedly in frequency-modulation such that said impedance is altered by an object in said surveillance space;

monitoring said impedance of said at least one source of sonic energy;

comparing said impedance with a reference value; and generating an alarm signal when said impedance departs from said reference value by more than a threshold value.

25. The method as defined in claim 24, further including the steps of:

selecting as said at least one source of sonic energy, a source of sonic energy containing a membrane of a preselected diameter;

emitting sonic energy of a preselected wavelength by said at least one sonic energy source in a main direction of radiation; and said step of driving said at least one source of sonic energy entailing driving said at least one source of sonic energy such that said at least one source of sonic energy defines a length dimension of said surveillance space in said main direction of radiation, said length dimension being at least approximately determined by the relationship:

$$L=D^2(4\lambda)$$

wherein:

L=said length dimension;

D=said diameter of said membrane; and

λ=said selected wavelength.

26. A short-range surveillance device, comprising:

at least one source of sonic energy having a membrane of a preselected diameter and defining a main direction of radiation;

said at least one source of sonic energy emitting sonic radiation of a preselected wavelength;

a driver circuit for driving said at least one source of sonic energy;

an evaluation circuit for emitting an alarm signal in response to at least one of motion and sojourn, or both, of an object which is more solid than ambient air and present within a surveillance space;

said surveillance space having a predeterminate length dimension extending in said main direction of radiation and dependent upon said preselected diameter of said membrane and said preselected wavelength of said sonic radiation emitted by said at least one source of sonic energy;

said length dimension being at least approximately determined by the relationship:

$$L=D^2/(4\lambda),$$

wherein L=said predeterminate length dimension of said surveillance space, D=said preselected diameter of said membrane, and λ=said preselected wavelength of said sonic radiation;

said driver circuit driving said source of sonic energy selectively such as to emit either continuous or pulsed sonic radiation of said preselected wavelength or continuous or pulsed frequency-modulated sonic radiation;

a current-measurement resistor connected in circuit with the at least one source of sonic energy;

said at least one source of sonic energy passing an electrical current through said current-measurement resistor during operation of said at least one source of sonic energy;

said electric current being subject to variations when said object more solid than ambient air is present in said surveillance space within said predeterminate length dimension; and a comparator circuit of said evaluation circuit being operatively connected to said current-measurement resistor and responding to said variations above a preset upper threshold value whenever said object more solid than ambient air is present in said surveillance space within said predeterminate length dimension.

* * * * *

UNITED STATES PATENT AND TRADEMARK OFFICE

CERTIFICATE OF CORRECTION

PATENT NO. : 4,755,973

DATED : July 5, 1988

INVENTOR(S) : WALTER MEIER and KURT MüLLER

It is certified that error appears in the above-identified patent and that said Letters Patent is hereby corrected as shown below:

Column 7, line 14, after "length" please insert --or length dimension L-- and after "this" insert --surveillance--

Column 7, line 14, after "space" please insert --13--

Column 10, line 39, please delete "and" and insert --said--

Column 10, line 44, please delete "volatage" and insert --voltage--

Column 13, line 51, after "$D^2$" please insert --/--(slash)

Signed and Sealed this

Twenty-seventh Day of December, 1988

*Attest:*

DONALD J. QUIGG

*Attesting Officer*

*Commissioner of Patents and Trademarks*